US008376477B2

(12) United States Patent
Schinzing

(10) Patent No.: US 8,376,477 B2
(45) Date of Patent: Feb. 19, 2013

(54) SHELF AND STORAGE UNIT

(76) Inventor: Daniel Lee Schinzing, Keene, TX (US)

( * ) Notice: Subject to any disclaimer, the term of this patent is extended or adjusted under 35 U.S.C. 154(b) by 31 days.

(21) Appl. No.: 12/925,552

(22) Filed: Oct. 25, 2010

(65) Prior Publication Data

US 2012/0098396 A1 Apr. 26, 2012

(51) Int. Cl.

| | |
|---|---|
| ***A47B 45/00*** | (2006.01) |
| ***A47B 53/00*** | (2006.01) |
| ***A47B 67/02*** | (2006.01) |
| ***A47F 5/08*** | (2006.01) |

(52) U.S. Cl. ..... 312/205; 312/245

(58) Field of Classification Search ..... 312/245–248, 312/242, 205, 321.5; 108/44, 45; 220/3.5, 220/3.6

See application file for complete search history.

(56) References Cited

U.S. PATENT DOCUMENTS

| | | | | | |
|---|---|---|---|---|---|
| 809,592 | A | * | 1/1906 | Watts | 312/242 |
| 974,852 | A | * | 11/1910 | Bishop | 312/101 |
| 1,059,464 | A | * | 4/1913 | Hine | 108/107 |
| 1,069,411 | A | * | 8/1913 | Greene | 312/101 |
| 1,072,490 | A | * | 9/1913 | Oilar | 5/505.1 |
| 1,320,392 | A | * | 11/1919 | Hirschman | 15/265 |
| 1,682,060 | A | * | 8/1928 | Banks | 211/43 |
| 2,069,635 | A | * | 2/1937 | Whenham | 211/35 |
| 2,195,919 | A | * | 4/1940 | Crilly et al. | 211/35 |
| 2,269,940 | A | * | 1/1942 | Johnson | 312/205 |
| 2,752,217 | A | * | 6/1956 | Sidney | 312/242 |
| 3,004,815 | A | * | 10/1961 | O'Kain et al. | 312/242 |
| 3,314,741 | A | * | 4/1967 | Litner | 312/242 |
| 3,501,020 | A | * | 3/1970 | Krikorian | 211/184 |
| 3,997,220 | A | * | 12/1976 | Mayer | 312/242 |
| 3,998,170 | A | * | 12/1976 | Gordon | 108/91 |
| 4,294,498 | A | * | 10/1981 | Van Luit | 312/245 |
| 4,319,792 | A | * | 3/1982 | Britt et al. | 312/245 |
| 4,941,716 | A | * | 7/1990 | Rome et al. | 312/205 |
| 5,484,196 | A | * | 1/1996 | Kim | 312/242 |
| 6,332,548 | B1 | * | 12/2001 | West et al. | 211/175 |
| D501,337 | S | * | 2/2005 | Berger et al. | D6/479 |
| 2009/0200903 | A1 | * | 8/2009 | Tassin et al. | 312/326 |

* cited by examiner

*Primary Examiner* — Janet M Wilkens
*Assistant Examiner* — Timothy M Ayres
(74) *Attorney, Agent, or Firm* — Lynn E. Barber

(57) ABSTRACT

A storage unit is provided for placement between upright studs of a wall. The unit may be unitary or be made into two telescoping box portions. Storage shelves are removably positioned in the interior area of the unit. For the two-piece unit, the storage shelves are made of two half shelves, with each half shelf having a terminal loop portion through which the other half shelf slides.

4 Claims, 6 Drawing Sheets

SHELF AND STORAGE UNIT

BACKGROUND OF THE INVENTION

1. Field of the Invention

This invention relates to storage, and in particular relates to shelving for such items as shoes.

2. Description of the Related Art

Because many people have many pairs of shoes that may be purchased for use for different types of occasions and to coordinate with their clothing, it is desirable to have efficient and organized use of space in residential homes and apartments. Thus, there are many storage organizers, shelving units, and other storage systems known in the art for storing shoes, and many more such systems for storing other items in the home or office. For example, numerous types of shoe racks have been developed for storing shoes in a convenient manner; some of which hold the shoes in a vertical orientation, such as on hoops, pegs or in pouches, while others retain the shoes in a horizontal, side-by-side position, such as on shelving, bars, or a cubby system. These methods for storing shoes are often designed around the physical restraints imposed by the shoe geometry, including width, height, and length, as well as restraints due to where the storage means are to be placed in the home. Examples of means to store shoes include boxes for holding one or more pairs of shoes, racks of various designs having multiple prongs or shelves on which the shoes may be placed, and hanging storage units with multiple bags or slots for shoes.

Storage units for shoes may be placed in closets or in bedrooms for use by the owner when dressing; however, for storage of the large number of pairs of shoes owned by typical consumers, there is often insufficient space to place bulky free-standing shelves or cabinets or boxes that will hold all of their shoes. Therefore people often must resort to stacking shoe boxes and containers on high shelves or under beds or in other out-of-the-way places, or to disorganized storage in larger boxes or bags in order to store the shoes out of sight when not in use.

Similar problems occur of course with the storage of other items in the home, for example, in the pantry or garage, such as storage of canned goods, hardware, tools, cosmetics and other personal items.

It is therefore an object of the invention to provide a storage unit that can be fit into the closet of a home without taking any normally used space in the closet. It is an object of the preferred embodiments of the invention herein to provide a storage unit that may be used for shoes and shoe-sized items; however, the size and relative dimensions of the invention herein may be varied for particular uses without departing from the invention herein.

Other objects and advantages will be more fully apparent from the following disclosure and appended claims.

SUMMARY OF THE INVENTION

The invention herein is storage unit, such as for shoes, for placement between upright studs of a wall, the unit comprising a rectangular outer box that may be unitary or be made into two telescoping box portions. Storage shelves are removably positioned in the interior area of the unit. For the two-piece unit, the storage shelves are made of two half shelves, with each half shelf having a terminal loop portion through which the other half shelf slides.

Other objects and features of the inventions will be more fully apparent from the following disclosure and appended claims.

DETAILED DESCRIPTION OF THE INVENTION AND PREFERRED EMBODIMENTS THEREOF

The present invention is preferably a shelf usable for shoes for placement between upright studs of a wall, the unit. The unit is made up of a rectangular outer box bounding an interior area. The rectangular outer box has a top wall having a front edge; a bottom wall having a front edge; a rear wall that covers the back of the unit; and two opposing parallel side walls. Each opposing parallel side wall has a bottom edge, a front edge, a rear edge, a top edge, an inner wall surface, an outer wall surface opposite the inner wall surface of the wall, and a plurality of shelf rests protruding from the inner wall surface into the interior area in opposition to a plurality of shelf rests on the opposing parallel side wall. The rear wall is joined to each of the opposing parallel side walls at a beveled vertical rear side edge. A plurality of storage shelves is removably positioned in the interior area, with each storage shelf having an upper shelf surface and two ends and with the two ends of each storage shelf supported by the shelf rests. The maximum width of the storage unit rear is substantially equal to the width between the upright studs.

The outer box in a first embodiment is integrally molded in one piece. Alternatively, in the preferred second embodiment, the outer box is formed by two outer box portions telescopically assembled together. In this embodiment the top wall there is a top wall segment on each outer box portion, a bottom wall segment on each outer box portion, and a rear vertical wall segment on each outer box portion. There is a side wall segment on each outer box portion, and one of which is shorter than the other opposing parallel side wall. Each of the storage shelves comprises two half shelves, with each half shelf having a terminal loop portion through which the other half shelf slides.

Preferably the storage unit(s) have a rectangular frame on the front edge of the top wall, bottom wall and opposing side walls, which frames the interior area.

Figure 1:
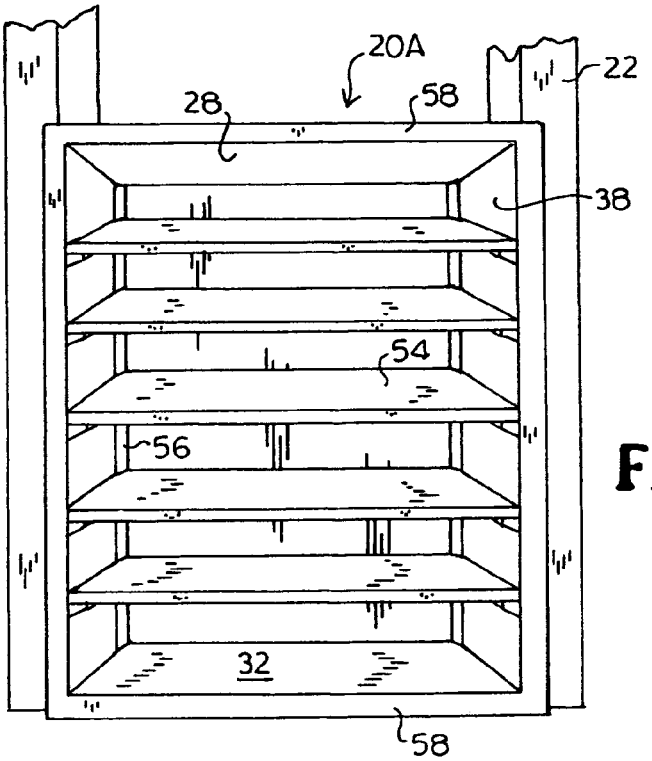
FIG. 1 is a front perspective view of a unitary shelf storage unit of a first embodiment of the invention herein.
Figure 2:
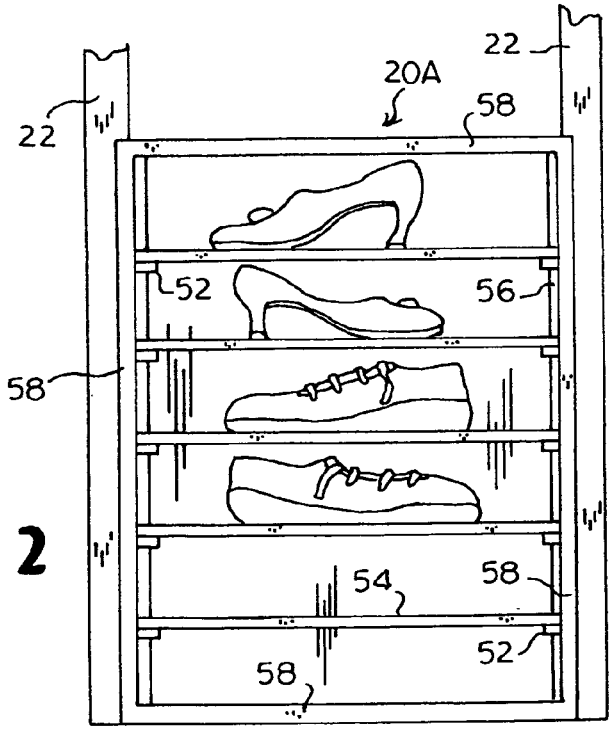
FIG. 2 is a front elevation view of the storage unit of FIG. 1 with shoes positioned on the shelves.

Referring now to the figures, the invention in particular is a storage unit 20A,B for placement between upright studs 22 of a wall (FIGS. 1-2). There are two primary preferred embodiments of the invention. As discussed in further detail below, in the first embodiment the storage unit 20A comprises a single rectangular box into which shelves are placed (FIGS. 1-5), and in the second embodiment of the storage unit 20B, the outer box has a variable width depending on the position of two outer halves of the unit when assembled together with the upper and lower edges of the unit sliding together (FIGS. 6-16).

Figure 3:
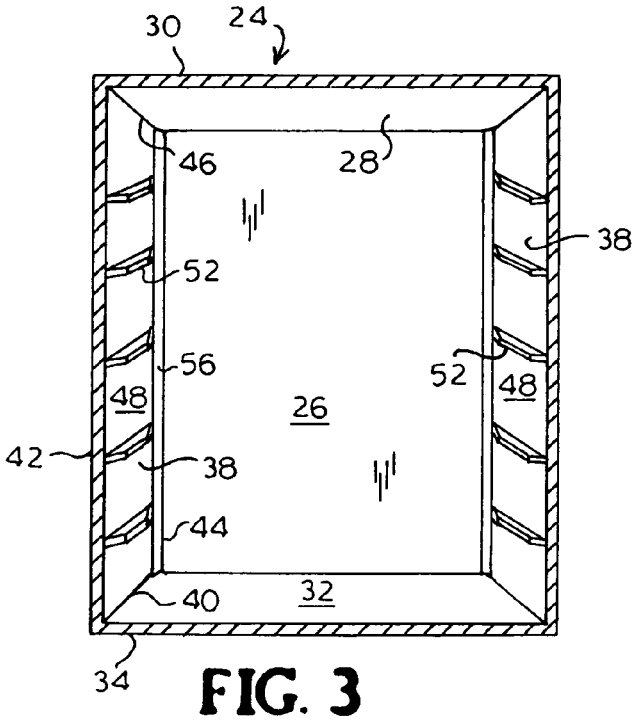
FIG. 3 is a front perspective view of the storage unit of FIG. 1 with the shelves and front frame removed.

The storage unit 20A of the invention in the first embodiment comprises a rectangular outer box 24 (FIG. 3) bounding an interior area 26. As shown in FIG. 3, the rectangular outer box 24 has a top wall 28 with a front edge 30 and a bottom wall 32 with a front edge 34. The storage unit 20A is preferably a width to fit closely between wall studs 24, preferably 16 inches, or 30 inches or other standard widths as known in the art of home construction.

Figure 4:
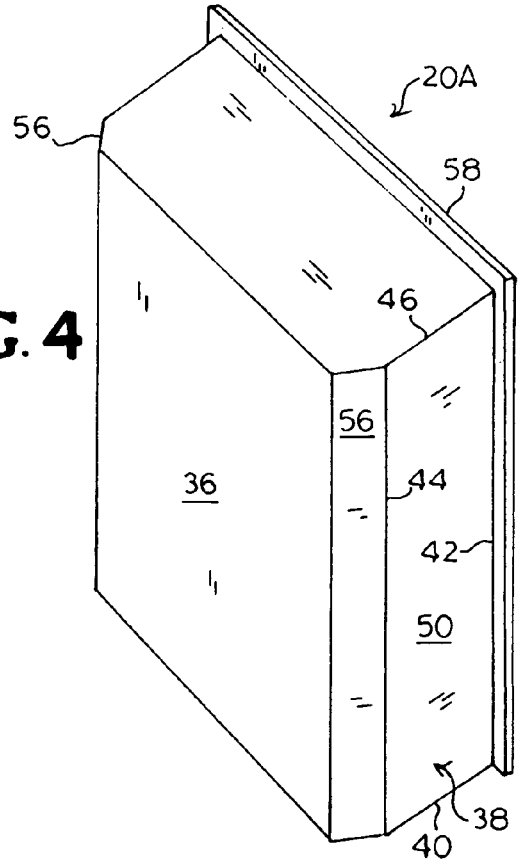
FIG. 4 is a side-back perspective view of the storage unit of FIG. 1.
Figure 5:
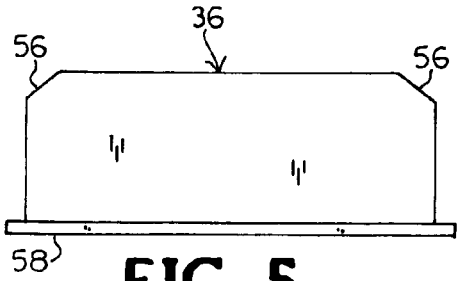
FIG. 5 is a top plan view of the storage unit of FIG. 1.

A rear wall 36 (FIG. 4) covers the back of the storage unit 20. Two opposing parallel side walls 38 complete the rectangular outer box 24 (FIGS. 1-4). As shown in FIGS. 3-4, each opposing parallel side wall 38 has a bottom edge 40, a front edge 42, a rear edge 44, a top edge 46, an inner wall surface 48, and an outer wall surface 50 opposite the inner wall surface 48 of the side wall 38.

Figure 13:
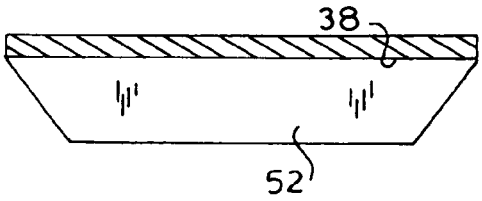
FIG. 13 is a top plan view of a shelf support of the invention.
Figure 14:
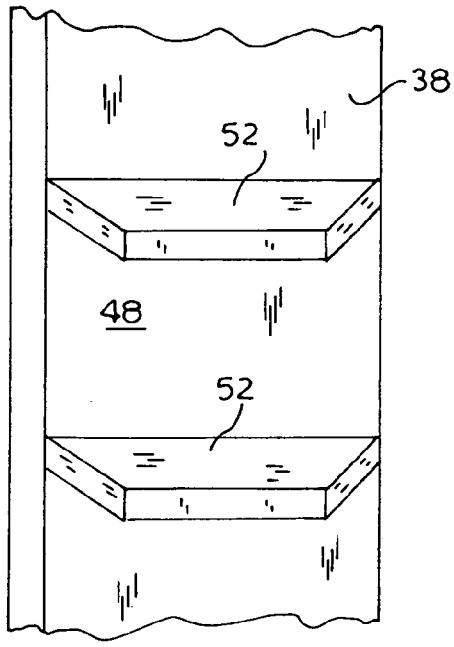
FIG. 14 is a perspective view of shelf supports of the invention.

The shelves for placement of shoes in the invention herein are placed on shelf rests 52 that protrude from the side walls 38. Preferably the shelf rests 52 are integrally formed with the side walls 38 and most preferably are trapezoidal in shape as shown in FIGS. 13-14. A plurality of shelf rests 52 protrudes from the inner wall surface 48 into the interior area 26 in opposition to a plurality of shelf rests 52 on the opposing parallel side wall 38. In the first embodiment of the invention for a unitary shelf unit (FIGS. 1-5), the shelf rests 52 on each side wall 38 are aligned at same height across from each other so that a single shelf 54 placed between shelf rests 52 is horizontal as shown in FIGS. 1-2.

The rear wall 36 is joined to each of the opposing parallel side walls 38 at a beveled vertical rear side edge 56 as shown in FIG. 4 so that the unit can fit between the studs, with the electrical cords that are typically positioned between studs 22 and the housing structure being located in the space between the beveled vertical rear side edges and the studs 22.

Figure 17:
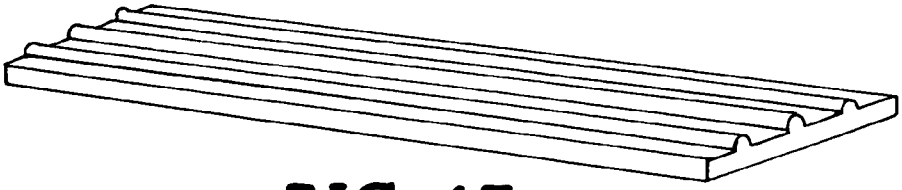
FIG. 17 is a perspective view of a shelf strengthened by ridges.

Storage shelves 54, each storage shelf having an upper shelf surface and two ends, are formed of a length equal to the width of the rear wall that extends between the side walls 38, so that the storage shelves 54 may be placed in the interior area 26 between opposing shelf rests 52. Optionally, the shelves in either embodiment of the invention discussed herein may be strengthened or constructed of different materials for structural or design purposes. Shelves with improved shelf rigidity and strength, for example, by addition of ridges, shown as lengthwise ridges in FIG. 17, may be substituted for simpler shelves as described herein. Thus for a typical shelf width, there can be 3 lengthwise ridges on the shelf underside. Additionally there may be 2 ridges on the top, so that when the shelves are stacked the ridges do not interfere with each other. Preferably, the ridges are 3/16 inch thick and 1/16 inch high. Each storage shelf 54 may also be formed of thin, tightly corrugated (waved) material (not shown).

Preferably the finished storage unit 20A further comprises an integral rectangular frame 58 on the front edge 30 of the top wall 28, the front edge 34 of the bottom wall 32 and the front edge 42 of the opposing side walls 38, framing the interior area 26 as shown in FIGS. 1 and 2 so that when viewed from the front, the storage unit 20A.

Figure 6:
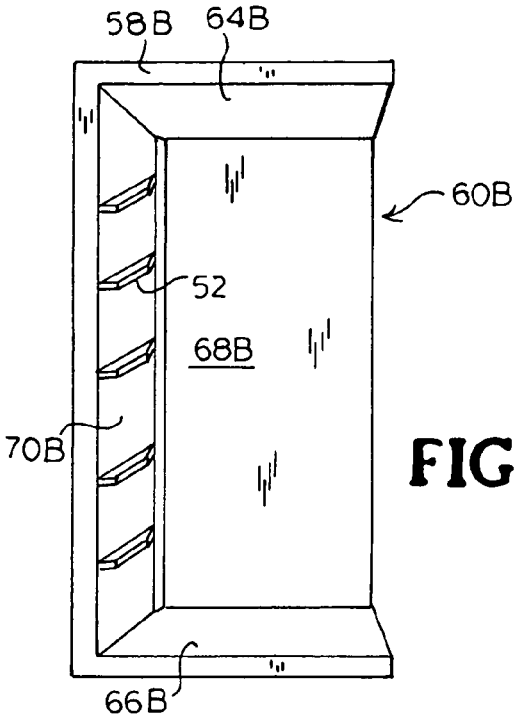
FIG. 6 is a front perspective view of one of the two outer box portions of a second embodiment of the storage unit of the invention herein.
Figure 10:
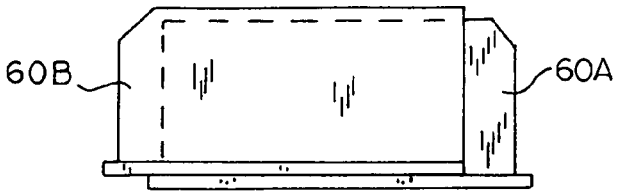
FIG. 10 is a top plan view of the storage unit of FIG. 6 when compressed.
Figure 7:
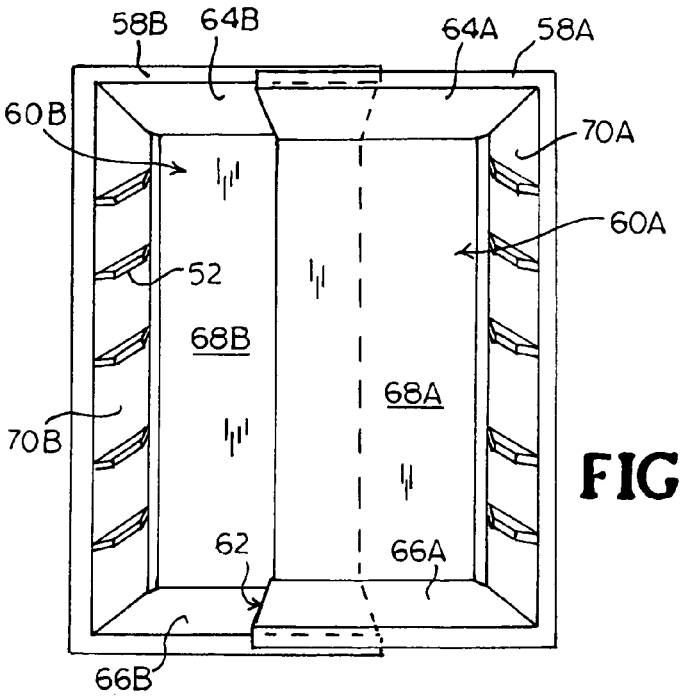
FIG. 7 is a front perspective view of the assembled second embodiment of the storage unit of FIG. 6 with a half-frame on each outer box portion.

In the second embodiment of the invention herein, the storage unit 20B is formed in two outer box portions 60A,B, which are assembled together, by inserting the outer edge 62 of the slightly smaller of the two outer box portions 60A into outer box portion 60B (FIGS. 6-7). The storage unit 20B in this second embodiment is assembled together so that the width of the unit 20B is substantially equal to the width between the upright studs in the wall area in which the unit 20B is being placed.

Figure 9:
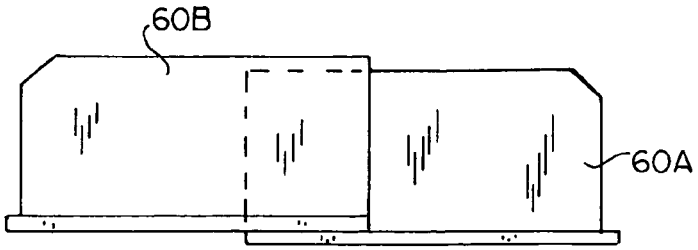
FIG. 9 is a top plan view of the storage unit of FIG. 6 when expanded.

Thus, in the assembled storage unit 20B, the outer box is two-part, formed by the two outer box portions 60A,B telescopically assembled together, so that in this embodiment of the invention, the top wall on the telescopically assembled outer box comprises the top wall segments 64A,B of the outer box portions 60A,B, the bottom wall on the telescopically assembled outer box comprises the bottom wall segments 66A,B of the outer box portions 60A,B, and the rear wall on the telescopically assembled outer box comprises the rear vertical wall segments 68A,B on the outer box portions 60A, B. To allow the two outer box portions 60A,B to telescopingly assemble together, one of the opposing parallel side walls 70A is shorter than the other opposing parallel side wall 70B in the second embodiment of the invention herein. The assembled storage unit 20B may thus be assembled to have a variety of widths as shown in FIG. 9 (expanded to a great width) and FIG. 10 (compressed to a lesser width).

Figure 8:
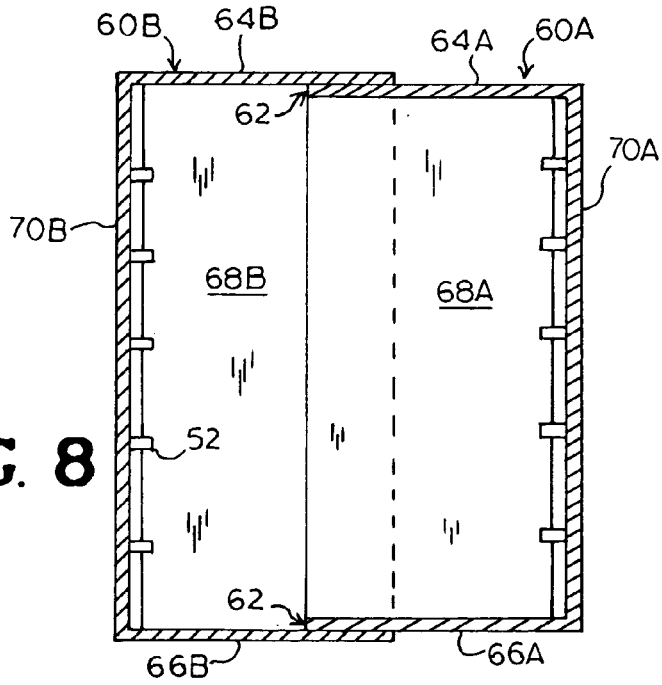
FIG. 8 is an elevational front view of the storage unit of FIG. 7 in which the frames have been omitted.

When the outer edge 62 of outer box portion 60A is inserted into outer box portion 60B as shown in FIGS. 7-8, the distance between side walls 70A and 70B can be varied to fit within different stud placement dimensions by sliding the outer box portion 60A so a different extent into outer box portion 60B.

Figure 11:
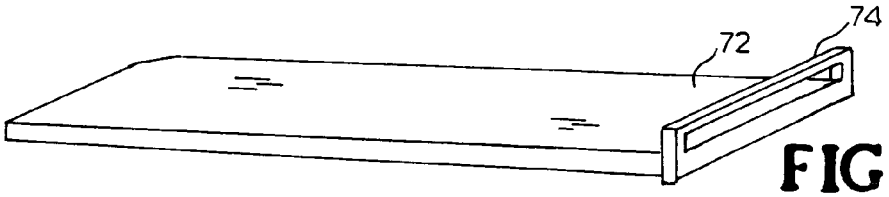
FIG. 11 is a front perspective view of a half shelf of the embodiment of FIG. 6.
Figure 12:
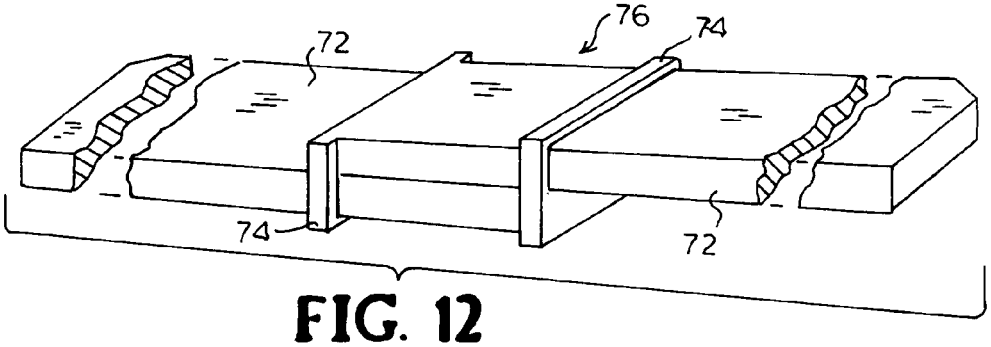
FIG. 12 is a front perspective view of half shelves assembled into a shelf unit in the embodiment of FIG. 6.

While different length shelves could be provided for use in shelf units when assembled into different sizes, the preferred shelves for use in the second embodiment of the invention are adjustable in length to fit into storage units with different dimensions when assembled. The preferred adjustable shelves are made up of two identical shelf half shelves 72, one of which is shown in FIG. 11. Each of the identical half shelves 72 has a terminal loop portion 74 as shown in FIGS. 11-12 through which the end of the other half shelf 72 that does not have a terminal loop portion slides. To place the half shelves 72 in the storage unit 20B, the half shelves 72 can be aligned one on top of the other with the terminal loop portion 74 on the top half shelf 72 extending downward and the terminal loop portion 74 on the bottom half shelf 72 extending upward. The end of each half shelf 72 without a loop portion is slid through the terminal loop portion on the other half shelf 72 to form a 2-part shelf of the correct length for the assembled storage unit 20B as shown in FIG. 15 (compressed to a short distance for a smaller inter-stud distance) and FIG. 16 (expanded to a longer 2-part shelf for a longer inter-stud distance).

Figure 15:
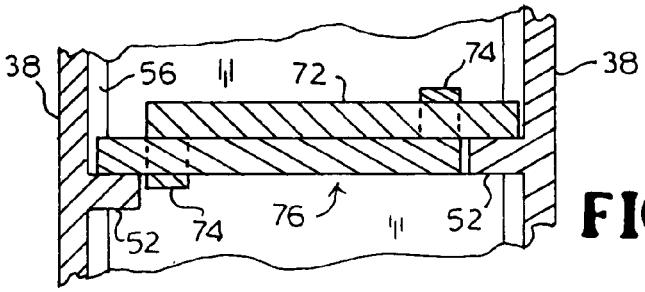
FIG. 15 is a cross-sectional view of compressed half shelves of the embodiment of FIG. 6.
Figure 16:
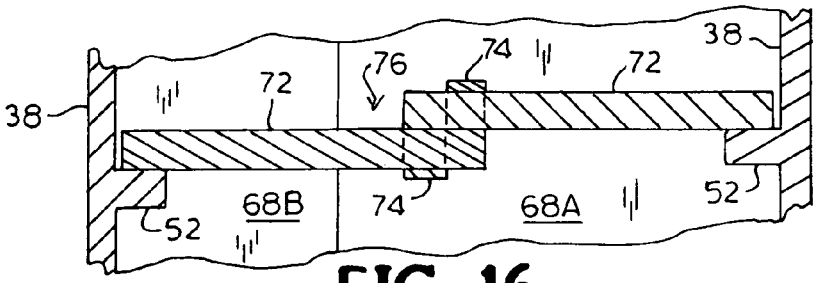
FIG. 16 is a cross-sectional view of expanded half shelves of the embodiment of FIG. 6.

Because use of the two preferred half shelves results in an assembled shelf unit 76 with one end higher than the other as shown in FIGS. 12, 15 and 16, the shelf rests 52 on the side walls 70A,B are placed slightly offset (by the thickness of the half shelves 72) so that the assembled shelf unit 76 lies horizontally within the storage unit 20B as shown.

The rectangular frame in the assembled storage unit 20B of the second embodiment comprises two half frames 58A,B, one on each outer box portion 60A,B (FIG. 7).

Preferably, in the first embodiment of the invention, the outer box 24 is preferably integrally molded in one piece, and in the second embodiment of the invention each outer box portion 60A,B is preferably integrally molded as known in the art. All portions of the invention in both preferred embodiments are preferably molded on sturdy durable plastic as known in the art for example, for shelf units, plastic furniture and the like.

Preferably the height of the storage unit of the invention is 24 to 92 inches. The front-to-back depth of the unit is preferably about 4 inches. The thickness of the various top, bottom and side walls is preferably ⅛ to ¼ inch. If the unit does not have a beveled rear edges, the width of the shelves is preferably 3⅝ to 3¾ inches; however, with beveled rear edges as is preferred, the width of the shelves is preferably about 3 inches. The shelves are preferably about 5-6 inches apart, so that for a unit that is 30 inches high, there are preferably 5-6 shelves.

To install the storage unit of the invention in a selected space, such as a closet, the items in the closet or around the selected space are removed and/or covered with plastic to prevent them becoming dirty. The wall board or other wall covering is removed over the area where the unit is to be placed, and the unit is placed therein. For the second embodiment of the invention, the two halves of the unit are placed in the selected space, and pulled apart to fit snugly within the space. If it is desired to have the unit installed above floor level, support structures may be placed between the studs at the desired level as known in the art, for example, 2×4's across between the studs. After the unit is placed in the desired position, the shelves are placed on the shelf supports, and may be firmly affixed to the wall by means known in the art, for example by nails or bolts.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A storage unit for placement between upright studs of a wall, the unit comprising:

a) a rectangular outer box bounding an interior area comprising i) a top wall having a front edge; ii) a bottom wall having a front edge; iii) a rear wall that covers the back of the unit; and iv) two opposing parallel side walls, each opposing parallel side wall having a bottom edge, a front edge, a rear edge, a top edge, an inner wall surface, an outer wall surface opposite the inner wall surface of the wall, and a plurality of shelf rests protruding from the inner wall surface into the interior area in opposition to a plurality of shelf rests on the opposing parallel side wall; wherein the rear wall is joined to each of the opposing parallel side walls at a beveled vertical rear side edge; and b) a plurality of storage shelves removably positioned in the interior area, each storage shelf having an upper shelf surface and two ends, the two ends of each storage shelf supported by the shelf rests; wherein a maximum width of the storage unit rear is substantially equal to the width between the upright studs; and wherein the outer box is formed by two outer box portions telescopically assembled together, wherein the top wall on the telescopically assembled outer box comprises a top wall segment on each outer box portion, the bottom wall on the telescopically assembled outer box comprises a bottom wall segment on each outer box portion, the rear wall on the telescopically assembled outer box comprises a rear vertical wall segment on each outer box portion, the opposing parallel side walls comprise a side wall segment on each outer box portion, and one of the opposing parallel side walls is shorter than the other opposing parallel side wall; and wherein each of the storage shelves comprises two half shelves, with each half shelf having a terminal loop portion through which the other half shelf slides.

2. The storage unit of claim 1, wherein each outer box portion is integrally molded in one piece.

3. The storage unit of claim 1, further comprising a rectangular frame on each outer box portion on the front edges of the top wall segment, bottom wall segment and side wall segment.

4. The storage unit of claim 1, wherein the shelf rests are trapezoidal in shape and are off set in position on the opposing parallel side walls so that a shelf assembled from two half shelves sits horizontally on the shelf rests.

* * * * *